US012601196B2

(12) United States Patent
Cleland

(10) Patent No.: US 12,601,196 B2
(45) Date of Patent: Apr. 14, 2026

(54) SWIMMING POOL PLATFORM DEVICE

(71) Applicant: Andrew Cleland, Glendale, AZ (US)

(72) Inventor: Andrew Cleland, Glendale, AZ (US)

( * ) Notice: Subject to any disclaimer, the term of this patent is extended or adjusted under 35 U.S.C. 154(b) by 75 days.

(21) Appl. No.: 18/619,989

(22) Filed: Mar. 28, 2024

(65) Prior Publication Data

US 2025/0305312 A1 Oct. 2, 2025

(51) Int. Cl.
*E04H 4/14* (2006.01)
*E04H 4/00* (2006.01)

(52) U.S. Cl.
CPC ..... *E04H 4/14* (2013.01); *E04H 4/0018* (2013.01)

(58) Field of Classification Search
CPC ..... A63B 69/14; A63B 69/12; E04H 4/144; E04H 4/14; E06C 1/36
See application file for complete search history.

(56) References Cited

U.S. PATENT DOCUMENTS

| | | | | |
|---|---|---|---|---|
| 3,813,703 | A | 6/1974 | Beaudin, Jr. | |
| D304,573 | S | 11/1989 | Hoszowski | |
| 5,307,527 | A * | 5/1994 | Schober | E04H 4/14 297/254 |
| 6,311,343 | B1 * | 11/2001 | Wisniewski | E04H 4/144 4/578.1 |
| 6,598,562 | B1 | 7/2003 | Dutkiewicz | |
| 6,942,062 | B2 | 9/2005 | Schmid, Jr. | |
| 9,212,497 | B2 * | 12/2015 | Chlapaty | A47C 4/286 |
| 10,458,138 | B2 * | 10/2019 | Masterson | E06C 1/36 |
| 11,274,460 | B2 | 3/2022 | Masterson | |
| 2005/0082438 | A1 | 4/2005 | Morral Gispert | |
| 2007/0006374 | A1 | 1/2007 | Sors | |
| 2022/0025669 | A1 * | 1/2022 | Mcdermott | E06C 1/39 |

FOREIGN PATENT DOCUMENTS

| | | |
|---|---|---|
| WO | WO2019083651 | 5/2019 |

* cited by examiner

*Primary Examiner* — Janie M Loeppke

(57) ABSTRACT

A swimming pool platform device includes an above ground swimming pool that has a perimeter wall defining an interior of the above ground swimming pool. A frame is provided which is comprised of a plurality of modular sections assembled to define a pair of grapples and a seat and a pair of legs. Each of the pair of grapples is extended over the perimeter wall of the above ground swimming pool having the seat being horizontally oriented and having each of the pair of legs abutting a floor of the above ground swimming pool. The frame is comprised of a corrosion resistant material. A panel is attached to the seat and a user can sit on the panel to facilitate the user to be supported in the swimming pool while the user is learning to swim.

9 Claims, 6 Drawing Sheets

SWIMMING POOL PLATFORM DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to swimming pool devices and more particularly pertains to a new swimming pool device for facilitating a user to sit in a swimming pool while the user is learning to swim. The device includes a frame that is comprised of a plurality of modular sections defining a seat and a pair of grapples and a pair of legs. Each of the grapples are extended over a perimeter wall of an above ground swimming pool such that the seat is aligned with a surface of the water in the above ground swimming pool and each of the pair of legs abuts a floor of the above ground swimming pool. In this way the seat of retained in a horizontal orientation to facilitate the user to sit on the seat.

(2) Description of Related Art Including Information Disclosed Under 37 CFR 1.97 and 1.98

The prior art relates to swimming pool devices including a variety of pool seat devices that each at least includes a frame that can be secured to an outer wall of a swimming pool and a seat that is attached to the frame for supporting a user. In no instance does the prior art disclose a pool seat device that includes a frame that is comprised of a plurality of modular sections that define a pair of grapples and a seat and a pair of legs such that the grapples can engage an outer wall of an above ground swimming pool to facilitate a user to sit on the seat.

BRIEF SUMMARY OF THE INVENTION

An embodiment of the disclosure meets the needs presented above by generally comprising an above ground swimming pool that has a perimeter wall defining an interior of the above ground swimming pool. A frame is provided which is comprised of a plurality of modular sections assembled to define a pair of grapples and a seat and a pair of legs. Each of the pair of grapples is extended over the perimeter wall of the above ground swimming pool having the seat being horizontally oriented and having each of the pair of legs abutting a floor of the above ground swimming pool. The frame is comprised of a corrosion resistant material. A panel is attached to the seat and a user can sit on the panel to facilitate the user to be supported in the swimming pool while the user is learning to swim.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of tis disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
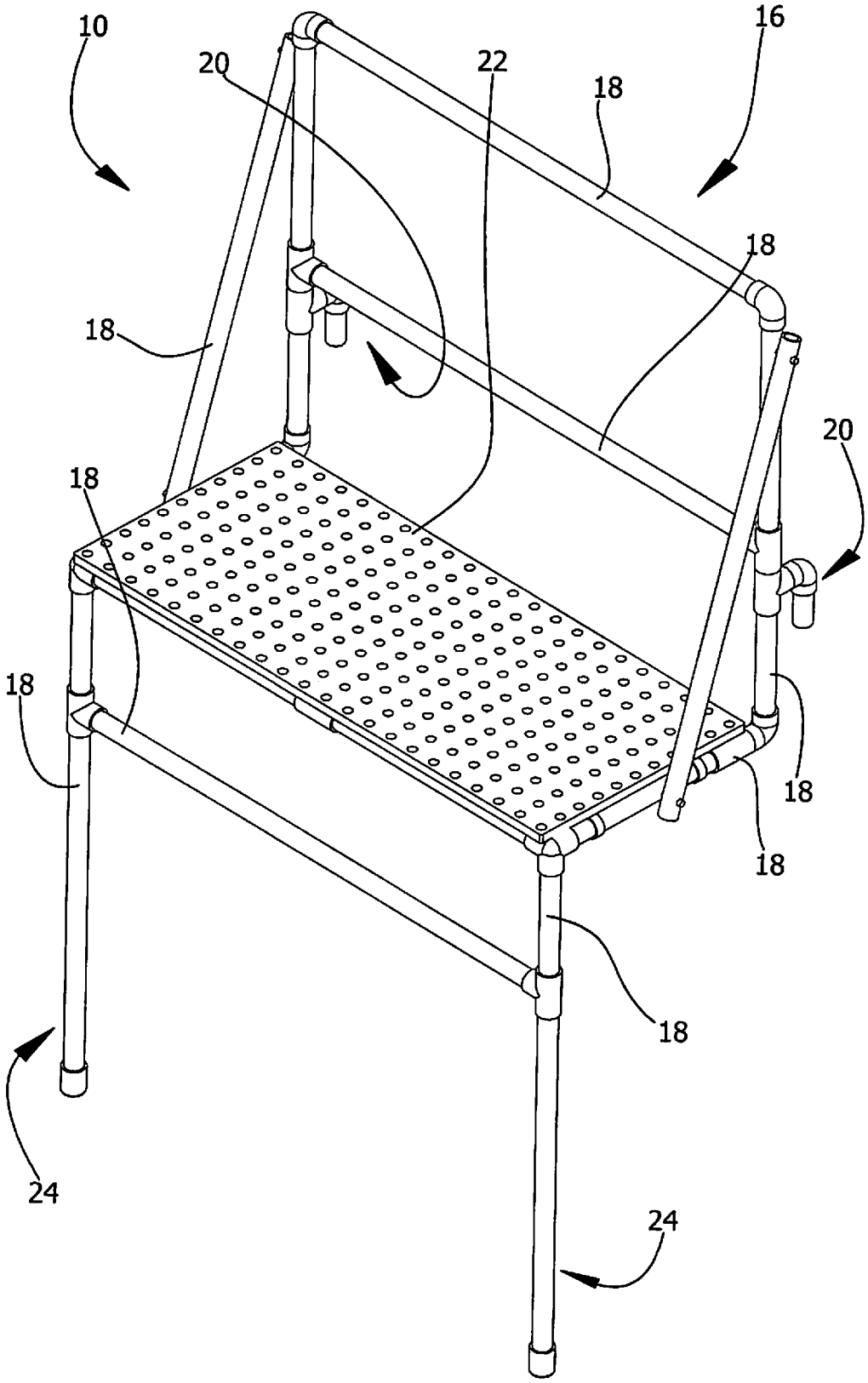
FIG. 1 is a front perspective view of a swimming pool platform device according to an embodiment of the disclosure.
Figure 2:
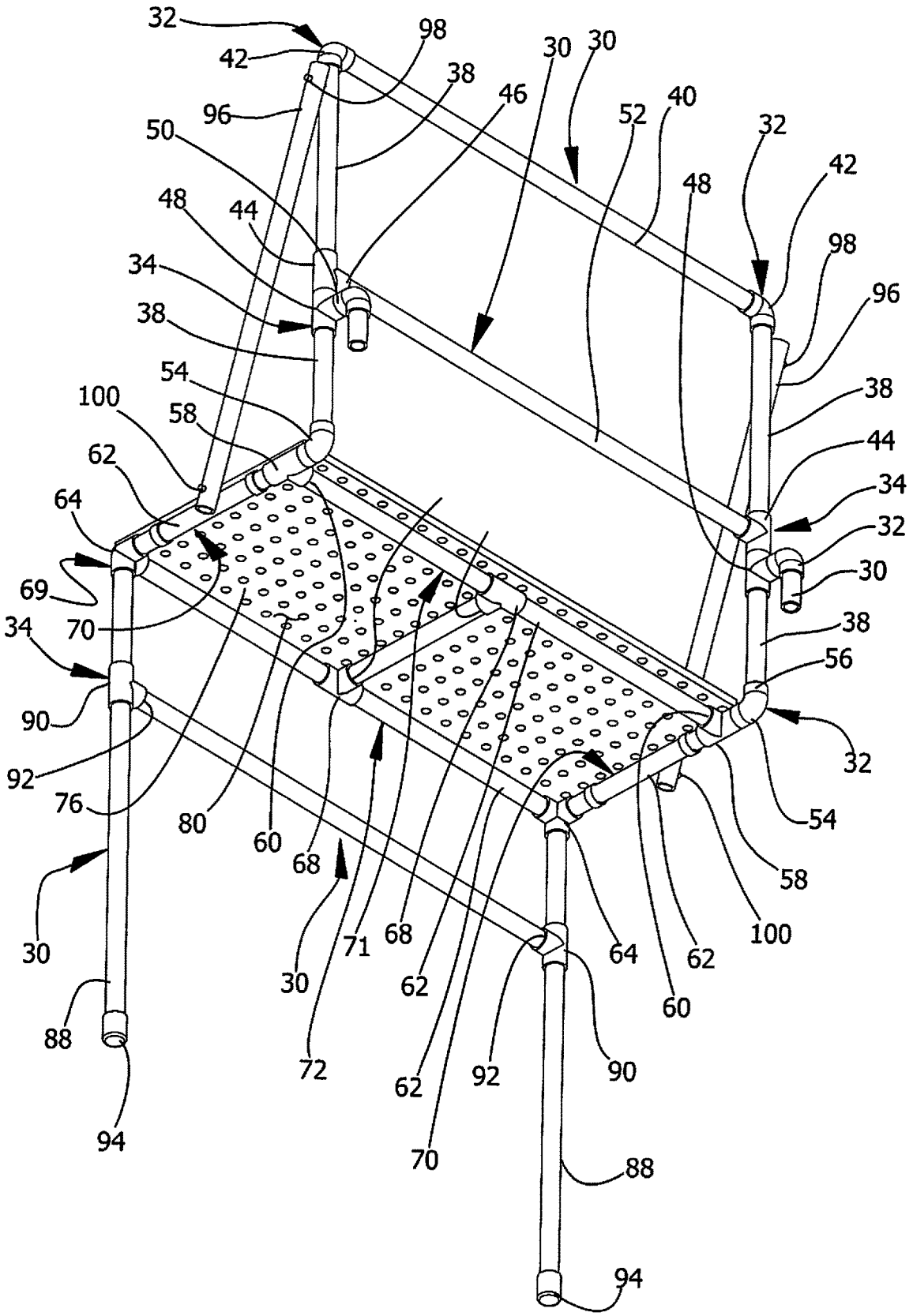
FIG. 2 is a bottom perspective view of an embodiment of the disclosure.
Figure 3:
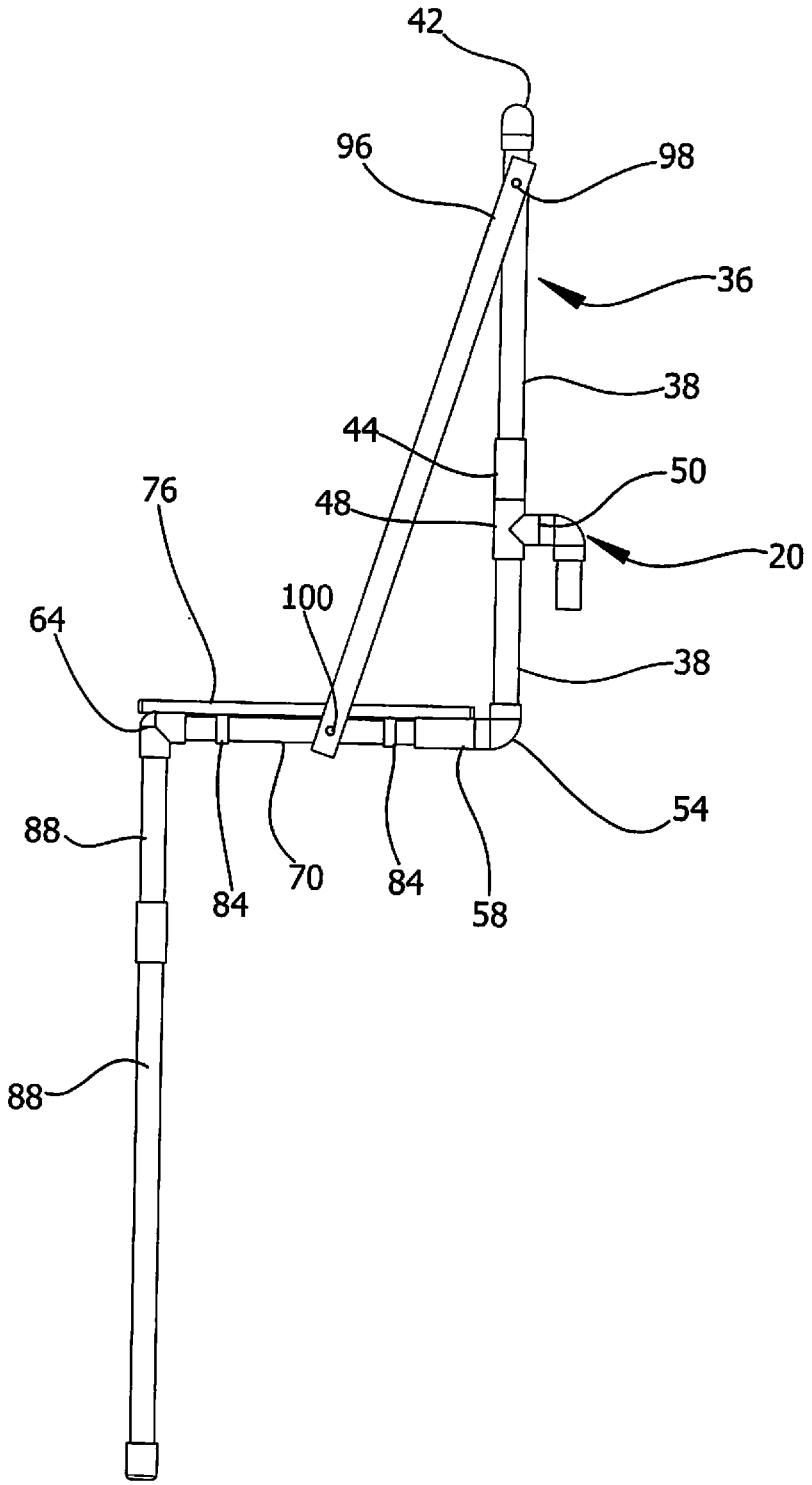
FIG. 3 is a left side view of an embodiment of the disclosure.
Figure 4:
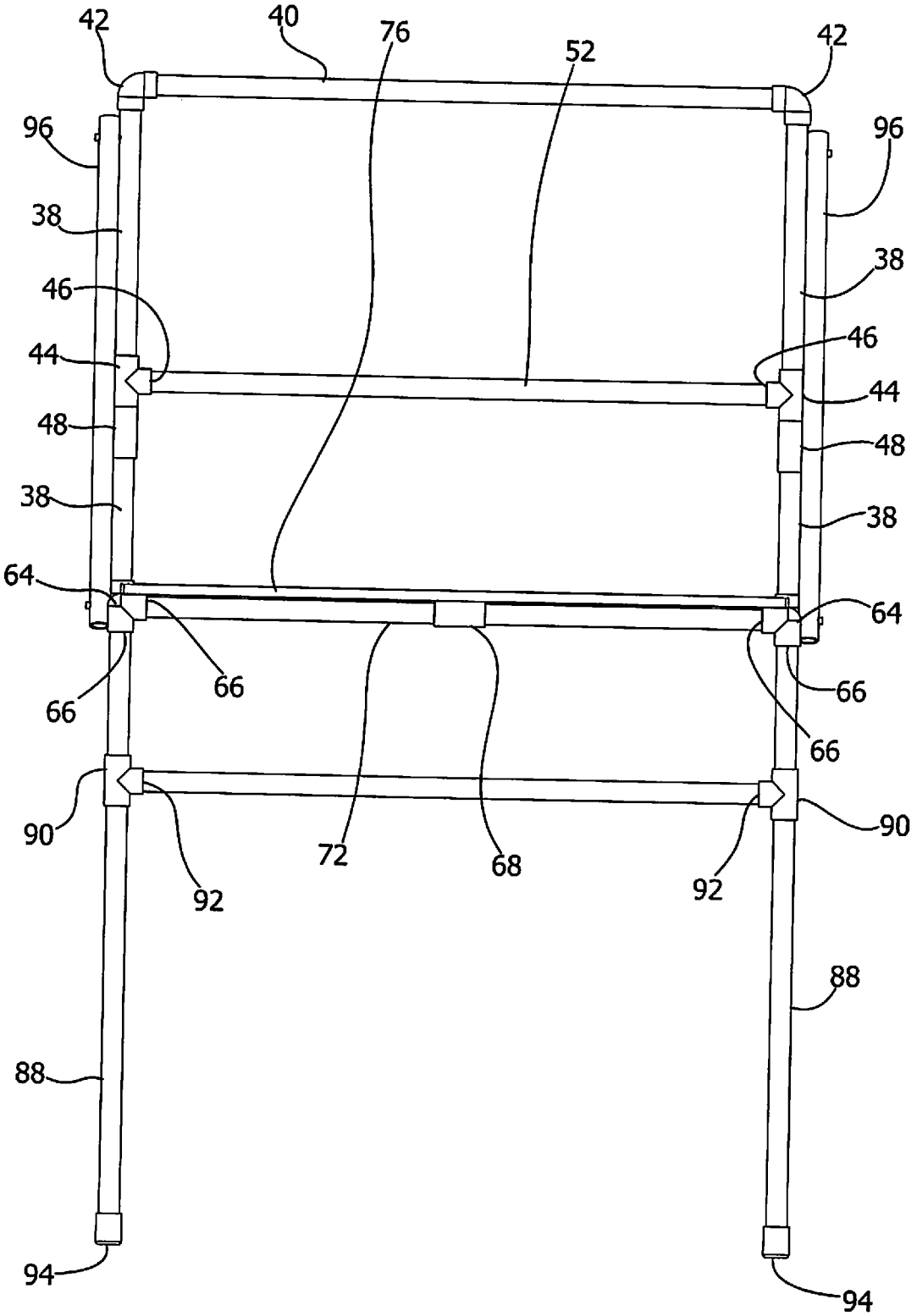
FIG. 4 is a front view of an embodiment of the disclosure.
Figure 5:
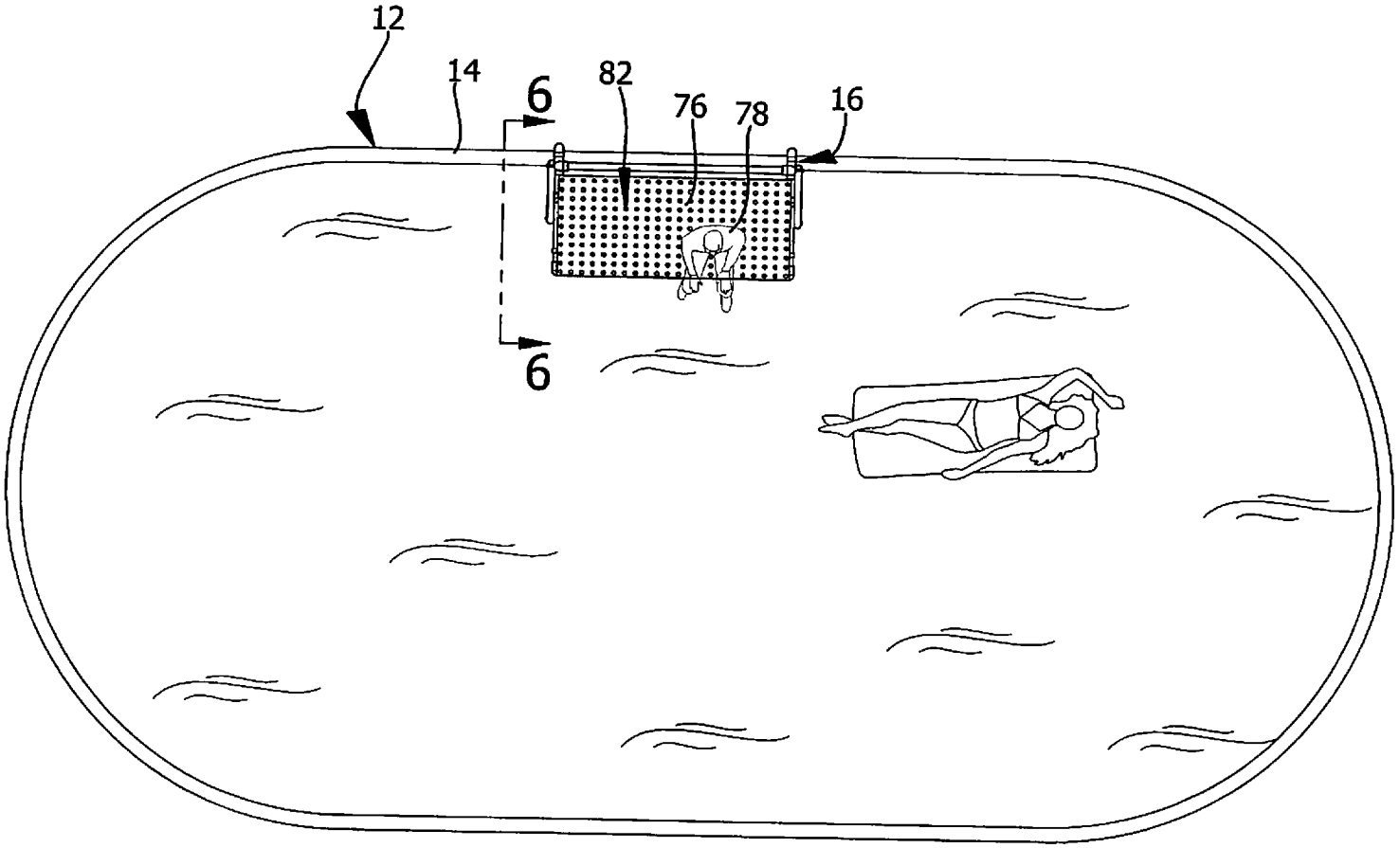
FIG. 5 is a perspective in-use view of an embodiment of the disclosure.
Figure 6:
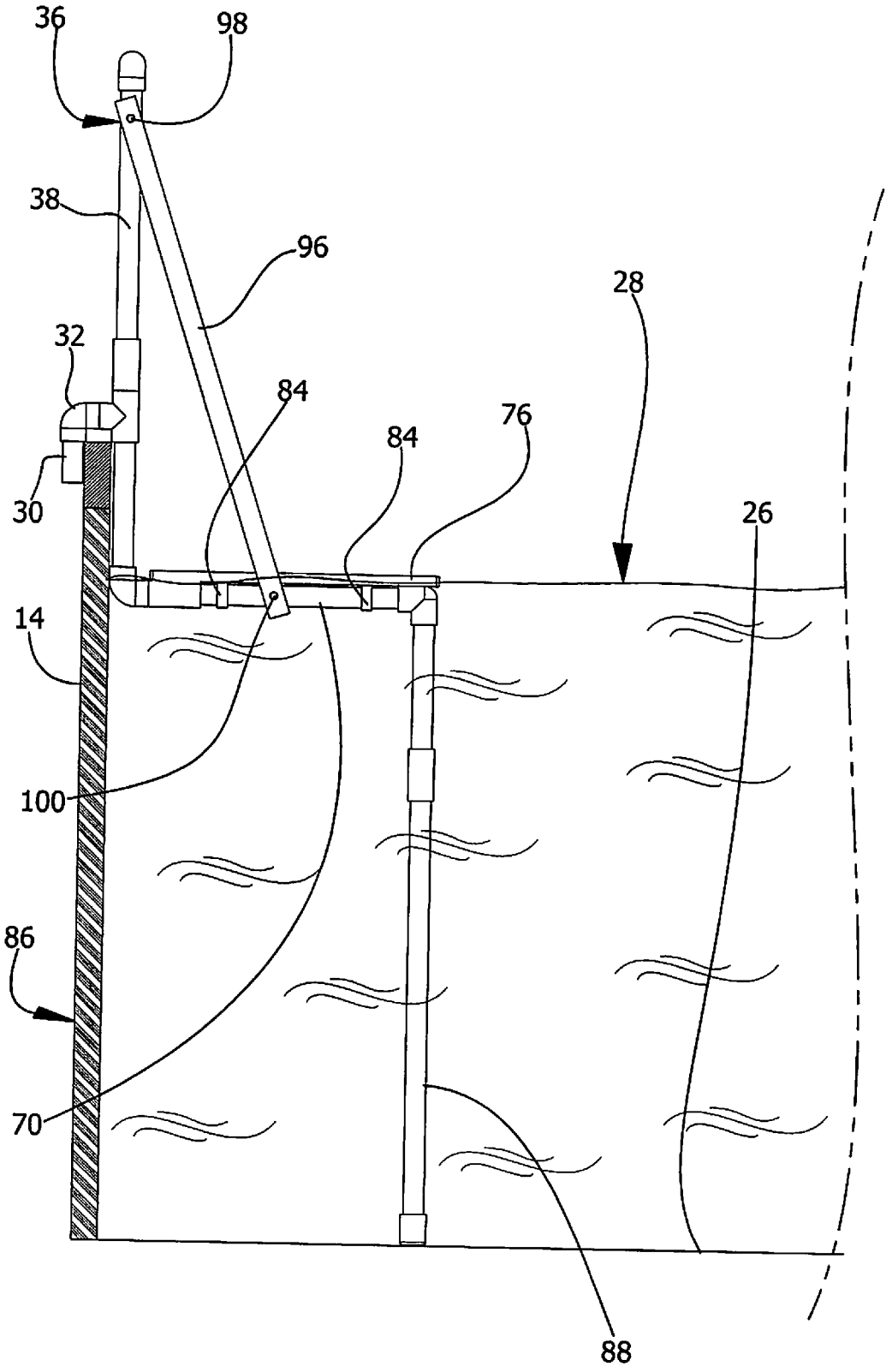
FIG. 6 is a cross sectional view taken along line 6-6 of FIG. 5 of an embodiment of the disclosure.

With reference now to the drawings, and in particular to FIGS. 1 through 6 thereof, a new swimming pool device embodying the principles and concepts of an embodiment of the disclosure and generally designated by the reference numeral 10 will be described.

As best illustrated in FIGS. 1 through 6, the swimming pool platform device 10 generally comprises an above ground swimming pool 12 that has a perimeter wall 14 defining an interior of the above ground swimming pool 12. The above ground swimming pool 12 may be of any conventional size and design that might commonly be found at a house, for example, or other type of privately owned residence. A frame 16 is included which is comprised of a plurality of modular sections 18 that are assembled to define a pair of grapples 20 and a seat 22 and a pair of legs 24. Each of the pair of grapples 20 is extended over the perimeter wall 14 of the above ground swimming pool 12 such that the seat 22 is horizontally oriented and each of the pair of legs 24 abuts a floor 26 of the above ground swimming pool 12. Furthermore, the frame 16 is comprised of a corrosion resistant material, including but not being limited to polyvinylchloride, thereby inhibiting the frame 16 from developing rust as a result of being exposed to water 28 in the above ground swimming pool 12.

The plurality of modular sections 18 includes a plurality of pipes 30 and a plurality of elbows 32 and a plurality of tees 34. Respective ones of the plurality of pipes 30 is attached to respective ones of the plurality of elbows 32 to define a backrest 36 of the seat 22. The plurality of pipes 30 of the backrest 36 includes a series of vertically oriented pipes 38 and a first horizontally oriented pipe 40 which is each attached to a first pair of the plurality of elbows 42. Furthermore, the first horizontally oriented pipe 40 extends between and is perpendicular to respective ones of the series of vertically oriented pipes 38. A first pair of the plurality of tees 44 is each attached between a respective pair of the series of vertically oriented pipes 38. Additionally, each of the first pair of tees 44 is oriented such that an exit 46 of each of the first pair of tees 44 is directed toward each other.

A second pair of the plurality of tees 48 is each attached between a respective pair of the series of vertically oriented pipes 38 such that each of the second pair of tees 48 abuts a respective one of the first pair of tees 44. Each of the pair of second tees 48 is oriented such that an exit 50 of each of the second pair of tees 48 is directed rearwardly from the respective pair of vertically oriented pipes 38. Furthermore, the plurality of pipes 30 of the backrest 36 includes a second horizontally oriented pipe 52 which extends between the exit 46 of each of the first pair of first tees 44 such that the second horizontally oriented pipe 52 is spaced below the first horizontally oriented pipe 40. Furthermore, a second pair of the plurality of elbows 54 is attached to a bottommost end 56 of a respective one of the series of vertically oriented pipes 38 of the backrest 36. A third pair of the tees 58 is each integrated into a respective one of the first pair of elbows 42 having the exit 60 of each of the third pair of tees 58 being directed toward each other. Additionally, each of the third pair of tees 58 lies on a plane that is perpendicularly oriented with the respective vertically oriented pipe 38.

The plurality of pipes 30 includes a series of platform pipes 62 and the plurality of elbows 32 includes a pair of three way elbows 64 which each has a plurality of exits 66 that are oriented perpendicular to each other. The plurality of tees 34 includes a pair of platform tees 68 and each of a first pair of the series of platform pipes 70 is coupled to a respective one of the third tees 34. In this way each of the first pair of platform pipes 70 is oriented parallel to each other and lies on a plane which is perpendicular to the backrest 36. Each of the pair of three way elbows 64 is coupled to a respective one of the first pair of platform pipes 70 having each of the pair of three way elbows 64 defining a respective one of a pair of front corners 69 of the seat 22. Furthermore, a respective exit 66 of each of the pair of three way elbows 64 is directed downwardly. A back one of a second pair of the platform pipes 71 is coupled between the exits 60 of each of the third pair of tees 58 and a front one of the second pair of platform pipes 72 is coupled between each of the pair of three way elbows 64. Additionally, the front one of the second pair of platform pipes 72 is oriented parallel to the back one of the second pair of platform pipes 71.

Each of the platform tees 68 is integrated into a respective one of the back one of the second pair of platform pipes 71 and the front one of the second pair of platform pipes 72 having the exit 74 of each of the pair of platform tees 68 being directed toward each other. A respective one of the series of platform pipes 62 is coupled between the exit 74 of each of the pair of platform tees 68. A panel 76 is attached to the seat 22 and the panel 76 can be sat upon by a user 78 to facilitate the user 78 to be supported in the swimming pool 12 while the user 78 is learning to swim. The user 78 may be a child that is learning to swim or an adult that is learning to swim or any other person that, for any reason, may wish to sit upon the panel 76 rather than stand or swim in the swimming pool 12. Furthermore, the panel 76 is foraminous to facilitate water 28 to drain through the panel 76.

The panel 76 has a bottom surface 80 which rests upon each of the series of platform pipes 62 such that the panel 76 defines a platform 82 of the seat 22. A plurality of hose clamps 84 is provided and each of the plurality of hose clamps 84 is coupled to the bottom surface 80 of the panel 76. Each of the plurality of hose clamps 84 extends around a respective one of the series of platform pipes 62 for securing the panel 76 to the series of platform pipes 62. Each of the plurality of hose clamps 84 is comprised of a corrosion resistant material, including but not being limited to stainless steel or aluminum, such that the plurality of hose clamps 84 are inhibited from rusting due to exposure to water 28 in the swimming pool 12.

Each of the pair of grapples 20 includes a respective pair of the elbows 32 and a respective pair of the plurality of pipes 30. Each of the pair of elbows 32 of the pair of grapples 20 is coupled to the exit 46 of a respective one of the first pair of tees 44 of the backrest 36. Additionally, each of the pair of pipes 30 of the pair of grapples 20 is coupled to a respective one of the pair of elbows 32 of the grapples 20 having each of the pair of pipes 30 of the pair of grapples 20 being spaced from and being oriented parallel to a respective one of the series of vertically oriented pipes 38 of the backrest 36. In this way the perimeter wall 14 of the above ground pool 12 can be positioned between the pair of pipes 30 of the pair of grapples 20 and the respective vertically oriented pipes 38. Thus, each of the pair of grapples 20 rests on top of the perimeter wall 14 and abuts an outwardly facing surface 86 of the perimeter wall 14.

The plurality of pipes 30 includes a series of leg pipes 88 and each of a respective pair of the series of leg pipes 88 is coupled to and extends downwardly from the exit 66 on a respective one of the pair of three way elbows 64 which is directed downwardly. In this way each of the respective pair of leg pipes 88 extends downwardly from the respective three way elbow 64. The plurality of tees 34 includes a pair of leg tees 90 and each of the pair of leg tees 90 is coupled to a respective one of the pair of leg pipes 88 such that an exit 92 of each of the pair of leg tees 90 is directed toward each other. A respective pair of the series of leg pipes 88 is coupled to and extends downwardly from a respective one of the pair of leg tees 90 thereby facilitating a bottom end 94 of each of the pair of leg pipes 88 in the pair of leg tees 90 to abut the floor 26 of the above ground pool 12. In this way the legs 24 retain the panel 76 in on a horizontal plane to facilitate the panel 76 to support the weight of the user 78.

A respective one of the series of leg pipes 88 is coupled between the exit 92 of each of the pair of leg tees 90. Furthermore, the respective leg pipe 88 that is coupled between the pair of leg tees 90 is spaced downwardly from and is oriented parallel to the front one of the second pair of platform pipes 62. The plurality of pipes 30 includes a pair of support pipes 96 and each of the pair of support pipes 96 is coupled between a respective one of the series of vertically oriented pipes 38 of the backrest 36 and a respective one of the first pair of the platform pipes 62. In this way the platform is retained in a perpendicular orientation with the backrest 36 of the seat 22.

A pair of first fasteners 98 is provided and each of the pair of first fasteners 98 extends through a respective one of the pair of support pipes 96 and a respective one of the series of vertically oriented pipes 38. In this way the pair of support pipes 96 is secured to the respective series of vertically oriented pipes 38. A pair of second fasteners 100 is provided and each of the pair of second fasteners 100 extends through a respective one of the pair of support pipes 96 and a respective one of the first pair of platform pipes 70. In this way the pair of support pipes 96 are secured to the first pair of platform pipes 70. Additionally, each of the pair of first fasteners 98 and each of the pair of second fasteners 100 may comprise a nut and a bolt or other type of releasably mechanical fastener. Furthermore, each of the pair of first fasteners 98 and each of the pair of second fasteners 100 may be comprised of a corrosion resistant material, including but not being limited to stainless steel or aluminum, such that the first fasteners 98 and the second fasteners 100 are inhibited from rusting due to exposure to the water 28 in the swimming pool 12.

In use, the frame 16 is positioned in the above ground swimming pool 12 such that the perimeter wall 14 of the above ground swimming pool 12 is positioned between each of the grapples 20 and the backrest 36 and each of the pair of legs 24 rests on the floor 26 of the above ground swimming pool 12. In this way the panel 76 is retained in a horizontal orientation to facilitate the user 78 to sit on the panel 76. Furthermore, each of the pair of legs 24 has a height that is sufficient to position the panel 76 at the surface of the water 28 or just below the surface of the water 28. Thus, the user 78 can sit on the panel 76 to acclimate themselves to being in the water 28 rather than standing in or swimming in the water 28. In this way the user 78 can slowly become comfortable with being in the water 28 while the user 78 is learning to swim, for example. Additionally, the user 78 can sit on the panel 76 to enjoy the water 28 if the user 78 is physically disabled or injured or otherwise incapable of safely entering the water 28.

With respect to the above description then, it is to be realized that the optimum dimensional relationships for the parts of an embodiment enabled by the disclosure, to include variations in size, materials, shape, form, function and manner of operation, device and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A swimming pool platform device for facilitating a user that is learning to swim to be supported in a swimming pool, said device comprising:

an above ground swimming pool having a perimeter wall defining an interior of said above ground swimming pool;

a frame comprised of a plurality of modular sections being assembled to define a pair of grapples and a seat and a pair of legs, each of said pair of grapples being extended over said perimeter wall of said above ground swimming pool having said seat being horizontally oriented and having each of said pair of legs abutting a floor of said above ground swimming pool, said frame being comprised of a corrosion resistant material thereby inhibiting said frame from developing rust as a result of being exposed to water in said above ground swimming pool;

a panel being attached to said seat wherein said panel is configured to be sat upon by a user to facilitate the user to be supported in said swimming pool while the user is learning to swim;

wherein said plurality of modular sections includes a plurality of pipes and a plurality of elbows and a plurality of tees;

wherein respective ones of said plurality of pipes is attached to respective ones of said plurality of elbows to define a backrest of said seat;

wherein said plurality of pipes of said backrest includes a series of vertically oriented pipes and a first horizontally oriented pipe each being attached to a first pair of said plurality of elbows such that said first horizontally oriented pipe extends between and is perpendicular to respective ones of said series of vertically oriented pipes;

wherein a first pair of said plurality of tees is each attached between a respective pair of said series of vertically oriented pipes;

wherein each of said first pair of tees is oriented such that an exit of each of said first pair of tees is directed toward each other;

wherein a second pair of said plurality of tees is attached between a respective pair of said series of vertically oriented pipes such that each of said second pair of tees abuts a respective one of said first pair of tees;

wherein each of said pair of second tees is oriented such that an exit of each of said second pair of tees is directed rearwardly from said respective pair of vertically oriented pipes;

wherein said plurality of pipes of said backrest includes a second horizontally oriented pipe which extends between said exit of each of said first pair of first tees such that said second horizontally oriented pipe is spaced below said first horizontally oriented pipe;

wherein a second pair of said plurality of elbows being attached to a bottommost end of a respective one of said series of vertically oriented pipes of said backrest; and wherein a third pair of said tees is each integrated into a respective one of said first pair of elbows having said exit of each of said third pair of tees being directed toward each other and having each of said third pair of tees lying on a plane being perpendicularly oriented with said respective vertically oriented pipe.

2. The device according to claim 1, wherein:

said plurality of pipes includes a series of platform pipes;

wherein said plurality of elbows includes a pair of three way elbows which each has a plurality of exits that are oriented perpendicular to each other;

wherein said plurality of tees includes a pair of platform tees;

wherein each of a first pair of said series of platform pipes is coupled to a respective one of said third tees such that each of said first pair of platform pipes is oriented parallel to each other lying on a plane being perpendicular to said backrest; and each of said pair of three way elbows is coupled to a respective one of said first pair of platform pipes having each of said pair of three way elbows defining a respective one of a pair of front corners of said platform such that a respective exit of each of said pair of three way elbows is directed downwardly.

3. The device according to claim 2, wherein:

a back one of a second pair of said platform pipes is coupled between said exits of each of said third pair of tees;

a front one of said second pair of platform pipes is coupled between each of said pair of three way elbows such that said front one of said second pair of platform pipes is oriented parallel to said back one of said second pair of platform pipes;

each of said platform tees is integrated into a respective one of said back one of said second pair of platform pipes and said front one of said second pair of platform pipes having said exit of each of said pair of platform tees being directed toward each other; and wherein a respective one of said series of platform pipes is coupled between said exit of each of said pair of platform tees.

4. The device according to claim 2, wherein:

said panel is foraminous wherein said panel is configured to facilitate water to drain through said panel;

said panel has a bottom surface resting upon each of said series of platform pipes such that said panel defines a platform of said seat;

said device includes a plurality of hose clamps;

each of said plurality of hose clamps is coupled to said bottom surface of said panel; and each of said plurality of hose clamps extends around a respective one of said series of platform pipes for securing said panel to said series of platform pipes.

5. The device according to claim 1, wherein:

each of said pair of grapples includes a respective pair of said elbows and a respective pair of said plurality of pipes;

each of said pair of elbows of said pair of grapples is coupled to said exit of a respective one of said first pair of tees of said backrest; and each of said pair of pipes of said pair of grapples is coupled to a respective one of said pair of elbows of said grapples having each of said pair of pipes of said pair of grapples being spaced from and being oriented parallel to a respective one of said series of vertically oriented pipes of said backrest thereby facilitating said perimeter wall of said above ground pool to be positioned between said pair of pipes of said pair of grapples and said respective vertically oriented pipes such that each of said pair of grapples rests on top of said perimeter wall and abuts an outwardly facing surface of said perimeter wall.

6. The device according to claim 3, wherein:

said plurality of pipes includes a series of leg pipes;

each of a respective pair of said series of leg pipes is coupled to and extends downwardly from said exit on a respective one of said pair of three way elbows which is directed downwardly such that each of said respective pair of leg pipes extends downwardly from said respective three way elbow;

said plurality of tees includes a pair of leg tees;

each of said pair of leg tees is coupled to a respective one of said pair of leg pipes such that an exit of each of said pair of leg tees is directed toward each other;

wherein a respective pair of said series of leg pipes is coupled to and extends downwardly from a respective one of said pair of leg tees thereby facilitating a bottom end of each of said pair of leg pipes in said pair of leg tees to abut said floor of said above ground pool for retaining said panel in on a horizontal plane wherein said panel is configured to support the weight of the user; and a respective one of said series of leg pipes is coupled between said exit of each of said pair of leg tees such that said respective leg pipe that is coupled between said pair of leg tees is spaced downwardly from and is oriented parallel to said front one of said second pair of platform pipes.

7. The device according to claim 2, wherein:

said plurality of pipes includes a pair of support pipes; and each of said pair of support pipes is coupled between a respective one of said series of vertically oriented pipes of said backrest and a respective one of said first pair of said platform pipes for retaining said platform in a perpendicular orientation with said backrest of said seat.

8. The device according to claim 7, wherein:

said device includes a pair of first fasteners;

each of said pair of first fasteners extends through a respective one of said pair of support pipes and a respective one of said series of vertically oriented pipes thereby securing said pair of support pipes to said respective series of vertically oriented pipes; and a pair of second fasteners, each of said pair of second fasteners extending through a respective one of said pair of support pipes and a respective one of said first pair of platform pipes for securing said pair of support pipes to said first pair of platform pipes.

9. A swimming pool platform device for facilitating a user that is learning to swim to be supported in a swimming pool, said device comprising:

an above ground swimming pool having a perimeter wall defining an interior of said above ground swimming pool;

a frame comprised of a plurality of modular sections being assembled to define a pair of grapples and a seat and a pair of legs, each of said pair of grapples being extended over said perimeter wall of said above ground swimming pool having said seat being horizontally oriented and having each of said pair of legs abutting a floor of said above ground swimming pool, said frame being comprised of a corrosion resistant material thereby inhibiting said frame from developing rust as a result of being exposed to water in said above ground swimming pool, said plurality of modular sections including a plurality of pipes and a plurality of elbows and a plurality of tees;

wherein respective ones of said plurality of pipes is attached to respective ones of said plurality of elbows to define a backrest of said seat, said plurality of pipes of said backrest including a series of vertically oriented pipes and a first horizontally oriented pipe each being attached to a first pair of said plurality of elbows such that said first horizontally oriented pipe extends between and is perpendicular to respective ones of said series of vertically oriented pipes, a first pair of said plurality of tees each being attached between a respective pair of said series of vertically oriented pipes, each of said first pair of tees being oriented such that an exit of each of said first pair of tees is directed toward each other, a second pair of said plurality of tees being attached between a respective pair of said series of vertically oriented pipes such that each of said second pair of tees abuts a respective one of said first pair of tees, each of said pair of second tees being oriented such that an exit of each of said second pair of tees is directed rearwardly from said respective pair of vertically oriented pipes, said plurality of pipes of said backrest including a second horizontally oriented pipe which extends between said exit of each of said first pair of first tees such that said second horizontally oriented pipe is spaced below said first horizontally oriented pipe, a second pair of said plurality of elbows being attached to a bottommost end of a respective one of said series of vertically oriented pipes of said backrest;

wherein a third pair of said tees is each integrated into a respective one of said first pair of elbows having said exit of each of said third pair of tees being directed toward each other and having each of said third pair of tees lying on a plane being perpendicularly oriented with said respective vertically oriented pipe;

wherein said plurality of pipes includes a series of platform pipes;

wherein said plurality of elbows includes a pair of three way elbows which each has a plurality of exits that are oriented perpendicular to each other;

wherein said plurality of tees includes a pair of platform tees;

wherein each of a first pair of said series of platform pipes is coupled to a respective one of said third tees such that each of said first pair of platform pipes is oriented parallel to each other lying on a plane being perpendicular to said backrest, each of said pair of three way elbows being coupled to a respective one of said first pair of platform pipes having each of said pair of three way elbows defining a respective one of a pair of front corners of said platform such that a respective exit of each of said pair of three way elbows is directed downwardly;

wherein a back one of a second pair of said platform pipes is coupled between said exits of each of said third pair of tees;

wherein a front one of said second pair of platform pipes is coupled between each of said pair of three way elbows such that said front one of said second pair of platform pipes is oriented parallel to said back one of said second pair of platform pipes;

wherein each of said platform tees is integrated into a respective one of said back one of said second pair of platform pipes and said front one of said second pair of platform pipes having said exit of each of said pair of platform tees being directed toward each other;

wherein a respective one of said series of platform pipes is coupled between said exit of each of said pair of platform tees;

a panel being attached to said seat wherein said panel is configured to be sat upon by a user to facilitate the user to be supported in said swimming pool while the user is learning to swim, said panel being foraminous wherein said panel is configured to facilitate water to drain through said panel, said panel having a bottom surface resting upon each of said series of platform pipes such that said panel defines a platform of said seat;

a plurality of hose clamps, each of said plurality of hose clamps being coupled to said bottom surface of said panel, each of said plurality of hose clamps extending around a respective one of said series of platform pipes for securing said panel to said series of platform pipes;

wherein each of said pair of grapples includes a respective pair of said elbows and a respective pair of said plurality of pipes, each of said pair of elbows of said pair of grapples being coupled to said exit of a respective one of said first pair of tees of said backrest, each of said pair of pipes of said pair of grapples being coupled to a respective one of said pair of elbows of said grapples having each of said pair of pipes of said pair of grapples being spaced from and being oriented parallel to a respective one of said series of vertically oriented pipes of said backrest thereby facilitating said perimeter wall of said above ground pool to be positioned between said pair of pipes of said pair of grapples and said respective vertically oriented pipes such that each of said pair of grapples rests on top of said perimeter wall and abuts an outwardly facing surface of said perimeter wall;

wherein said plurality of pipes includes a series of leg pipes, each of a respective pair of said series of leg pipes being coupled to and extending downwardly from said exit on a respective one of said pair of three way elbows which is directed downwardly such that each of said respective pair of leg pipes extends downwardly from said respective three way elbow;

wherein said plurality of tees includes a pair of leg tees, each of said pair of leg tees being coupled to a respective one of said pair of leg pipes such that an exit of each of said pair of leg tees is directed toward each other;

wherein a respective pair of said series of leg pipes is coupled to and extends downwardly from a respective one of said pair of leg tees thereby facilitating a bottom end of each of said pair of leg pipes in said pair of leg tees to abut said floor of said above ground pool for retaining said panel in on a horizontal plane wherein said panel is configured to support the weight of the user;

wherein a respective one of said series of leg pipes is coupled between said exit of each of said pair of leg tees such that said respective leg pipe that is coupled between said pair of leg tees is spaced downwardly from and is oriented parallel to said front one of said second pair of platform pipes;

wherein said plurality of pipes includes a pair of support pipes, each of said pair of support pipes being coupled between a respective one of said series of vertically oriented pipes of said backrest and a respective one of said first pair of said platform pipes for retaining said platform in a perpendicular orientation with said backrest of said seat;

a pair of first fasteners, each of said pair of first fasteners extending through a respective one of said pair of support pipes and a respective one of said series of vertically oriented pipes thereby securing said pair of support pipes to said respective series of vertically oriented pipes; and a pair of second fasteners, each of said pair of second fasteners extending through a respective one of said pair of support pipes and a respective one of said first pair of platform pipes for securing said pair of support pipes to said first pair of platform pipes.

* * * * *